US005224886A

United States Patent [19]

Cunningham

[11] Patent Number: 5,224,886

[45] Date of Patent: Jul. 6, 1993

[54] FLOATATION APPARATUS FOR USE WITH A STANDARD BICYCLE

[76] Inventor: Bruce D. Cunningham, R.D. #1, Box 2035, Huntington, Vt. 05462

[21] Appl. No.: 884,363

[22] Filed: May 18, 1992

[51] Int. Cl.[5] ..... B63H 21/175

[52] U.S. Cl. ..... 440/12; 114/283

[58] Field of Search ..... 440/12, 26, 27, 31, 440/11; 114/283

[56] References Cited

U.S. PATENT DOCUMENTS 577,269 2/1897 Powley ..... 440/12

4,936,801 6/1990 Herrit ..... 440/12

FOREIGN PATENT DOCUMENTS 3111630 11/1982 Fed. Rep. of Germany ..... 440/11

850964 12/1939 France ..... 440/12

*Primary Examiner*—Jesus D. Sotelo

*Attorney, Agent, or Firm*—Thomas N. Neiman

[57] ABSTRACT

The floatation apparatus for use with a standard bicycle a hull of catamaran or pontoon with a tubular structure to support a standard bicycle. The front wheel of the bicycle will be removed and the front fork will be attached to a support that is connected to a rudder in order to provide a steering mechanism. The rear wheel of the bicycle will rest on a rotating drum that will provide power to a drive propeller. The bike will be kept in an upright position by a support yoke which will allow the rear wheel of the bicycle to rotate. The hull or hulls of the apparatus will be of sufficient length and width to provide complete stability for the apparatus.

7 Claims, 2 Drawing Sheets

FLOATATION APPARATUS FOR USE WITH A STANDARD BICYCLE

This invention pertains to floatation devices, and, in particular, to a floatation apparatus that is designed to be used with a standard bicycle to allow an individual to have a self propelled water vehicle that can be easily assembled or disassembled for use as desired.

Many millions of people in the United States and around the world ride bicycles on a regular basis. Fewer people own water craft with which to have boating activities on a regular basis. What is needed is an apparatus that will permit an individual to easily convert a standard bicycle to a self propelled water vehicle by attaching it to a floatation device.

There have been a number of attempts to creating flexibility in floatation apparatus. A pair of United States patents issued to Mohammed S. Gof on Feb. 12, 1974, U.S. Pat. No. 3,791,332 for a Water Bike shows a bike having a pair of passenger carrying side boats and on May 4, 1976, U.S. Pat. No. 3,954,079 for a Dual Hull Water Bicycle. Clearly, it is desirable for an apparatus of this type to be very lightweight and flexible. At the same time, the apparatus should be easy to install and be extremely simple to attach to floatation apparatus and, at the same time, be able to use a standard bicycle. Another object of this invention is to provide an apparatus that has an ease of manufacture and ease of assembly. It is an object of this invention to set forth an improved floatation apparatus which avoids the disadvantages, limitations, above-recited, obtained from prior floatation apparatus.

Particularly, it is the object of this invention to set forth a floatation apparatus for use with a standard bicycle, for use in allowing an individual the ability to have a self propelled water craft comprising floatation means; said floatation means comprising means with sufficient area of buoyancy to allow a standard bicycle and rider to maintain their balance on the surface of the water; said floatation means having frame means; said frame means comprising means for attaching a bicycle frame to said floatation means; said frame attaching means comprising a base support plate; said base support plate having an adjustable support frame connected to said base support plate; said adjustable support frame having guide tracks positioned on said floatation means for allowing said adjustable support frame to slide into the desired position to receive said bicycle frame; said adjustable support frame further having quick release means; said frame attaching means having bicycle fork receiving means; said bicycle fork receiving means comprising an angled tubular frame; said angled tubular support means having locking means; said frame means further having directional control means; drive means; said drive means comprising means for receiving the rear wheel of a bicycle; said wheel receiving means comprising rotatable drum means for permitting said rear wheel of said bicycle positioned between and allow free rotation of said rear wheel; said rotatable drum means having transmission means; said transmission means comprising belt means; said transmission means further comprising pulley means; and said drive means having a propeller contacting said transmission means through a shaft means.

Further objects and features of this invention will become more apparent by reference to the following description taken in conjunction with the accompanying figure, in which.

Figure 1:
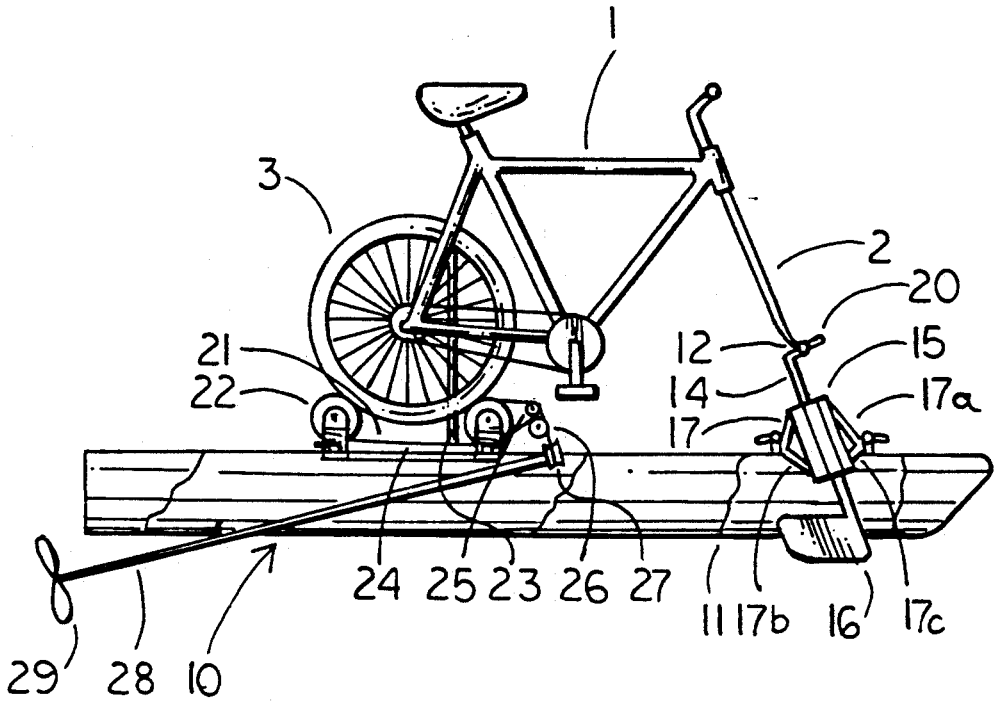
FIG. 1 is a side elevational view of the novel floatation apparatus.
Figure 2:
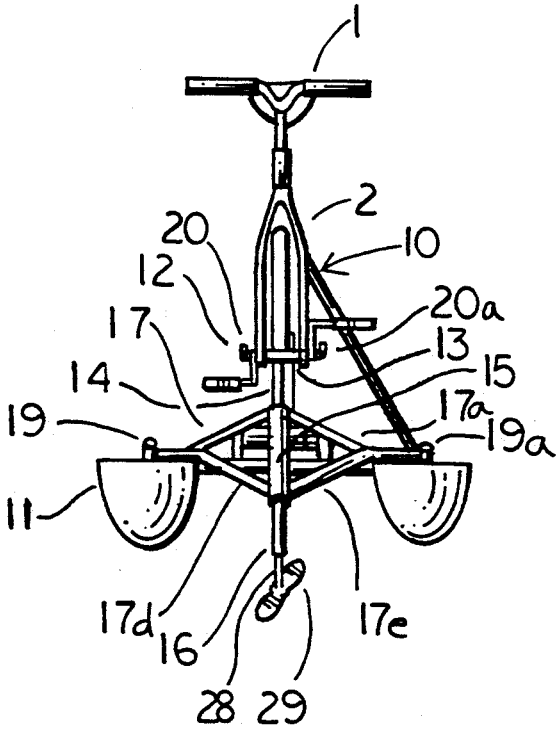
FIG. 2 is a front elevational view thereof.
Figure 3:
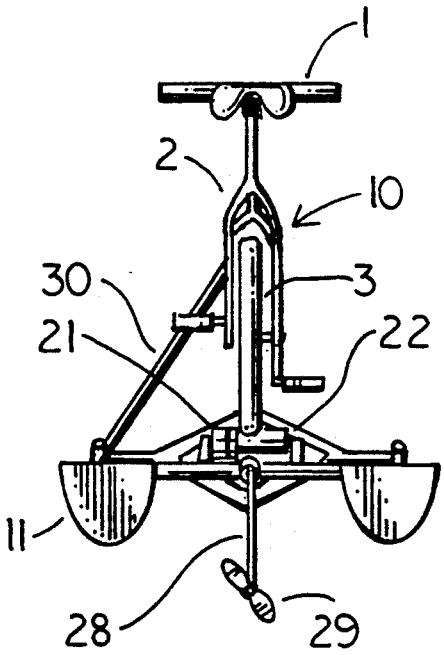
FIG. 3 is a rear elevational view thereof.
Figure 4:
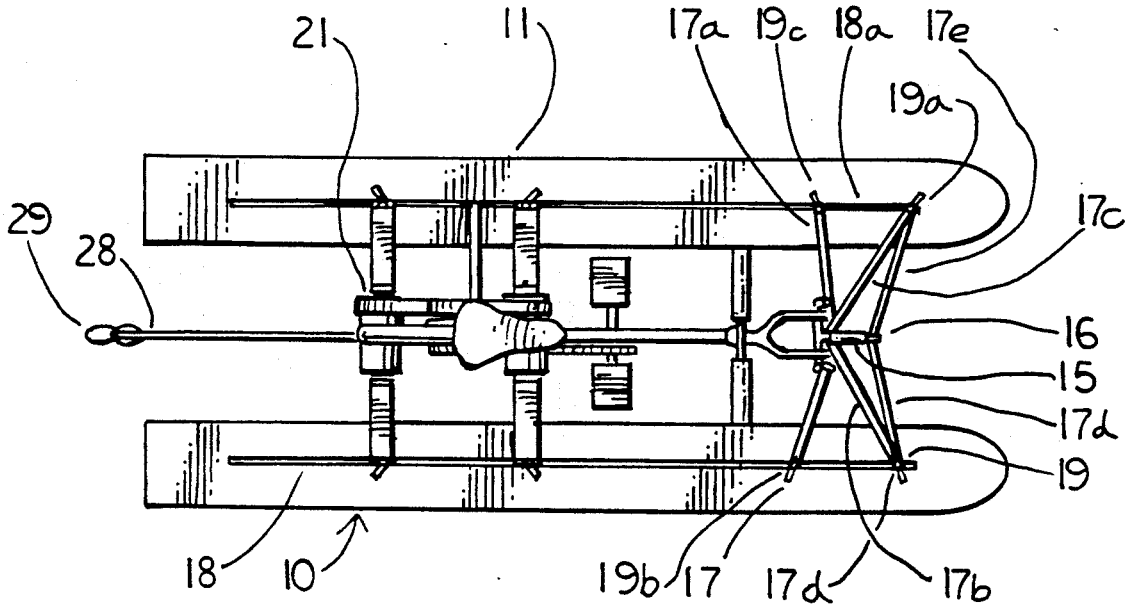
FIG. 4 is a top plan view thereof.

As shown in the figures, the novel floatation apparatus 10 comprises a catamaran or pontoon hull 11 that is sized to provide sufficient buoyancy to support a standard bicycle and rider on the water's surface with the balance required for stability. The front wheel of the bicycle 1 is removed and the front fork 2 of the bicycle will attach to a fork support frame 12 which comprises an angled tubular structure with a horizontal portion 13. The stem 14 of the fork support frame 14 extends downward through a sieeve 15 and has a directional control rudder 16. Therefore, when the user turns the handle bars, the rudder will turn the apparatus in a corresponding direction. A plurality of stability rods 17, 17*a*, 17*b*, 17*c*, 17*d* and 17*e* hold the bike upright and fit in guide tracks 18 and 18*a* located on the hulls. The purpose of the guide tracks is to be able to adjust the stability rods and the fork support frame for varying sized bicycles. A number of quick release clamps 19, 19*a*, 19*b* and 19*c* allow the directional control mechanism to be quickly attached to or released from the pontoons to facilitate transporting the device on land. The drive mechanism is similarly attached with quick release devices for the same reason. Tightening locks 20 and 20*a* allow the bicycle to be quickly attached or quickly released from the floatation apparatus.

The drive mechanism 21 of the apparatus 10 comprises a plurality of rotating drums 22 and 23 that are positioned between the hulls on support rods and bearings. The drive mechanism 21 is also mounted on tracks 18 and 18*a* so that the entire assembly with the bicycle attached may be adjusted fore and aft to level the craft in the water. The rear wheel 3 of the bicycle fits freely between the drums. The user will mount the bicycle 1 and initiate pedaling. The rotation of the front drum 23 will start rotating a belt 24 that is positioned around idler pulleys 25, 26, and drive pulley 27. Drive pulley 27 is attached to drive shaft 28 and the turning of the pulleys will, in turn, drive the shaft and rotate the propeller 29. This activity will create the forward motion for the apparatus.

In operation, the user would remove the front wheel of the bicycle and position the rear wheel between the drive drum. He or she will take front portion of the bike and put the forks in the fork support frame and tighten down the two locking devices. An adjustable stability rod 30 would then be attached to the rear of the bicycle by means of the quick release mechanisms. The rider can then mount the bicycle and begin to pedal.

While I have described my invention in connection with specific embodiments thereof, it is clearly to be understood that this is done only by way of example and not as a limitation to the scope of my invention as set forth in the objects thereof and in the appended claims.

I claim:

1. A floatation apparatus for use with a standard bicycle, for use in allowing an individual the ability to have a self propelled water craft, comprising:

floatation means;

said floatation means comprising means with a sufficient area of buoyancy to allow a standard bicycle and rider to maintain their balance on the surface of the water;

said floatation means having frame means for permitting said bicycle to have a support base;

said frame means comprising means for attaching a bicycle frame to said floatation means;

said support base having an adjustable support frame connected to said base support plate;

said adjustable support frame having guide tracks positioned on said floatation means for allowing said adjustable support frame to slide into the desired position to receive said bicycle frame;

said adjustable support frame further having quick release means;

said frame attaching means having bicycle fork receiving means;

said bicycle fork receiving means comprising an angled tubular support;

said angled tubular support having locking means;

said frame means further having directional control means;

said frame means further having drive means;

said drive means comprising means for receiving the rear wheel of a bicycle;

said wheel receiving means comprising a plurality of rotatable drum means for permitting said rear wheel of said bicycle positioned between each of said rotatable drums and allow free rotation of said rear wheel;

said rotatable drum means having transmission means;

said transmission means comprising belt means;

said transmission means further comprising pulley means; and said drive means having a propeller contacting said transmission means through a shaft means.

2. A floatation apparatus for use with a standard bicycle, according to claim 1, wherein:

said floatation means comprises a catamaran unit having a dual pontoon hull unit.

3. A floatation apparatus for use with a standard bicycle, according to claim 1, wherein:

said frame means comprises a tubular structure positioned between said floatation means.

4. A floatation apparatus for use with a standard bicycle, according to claim 1, wherein:

said quick release means comprises a clamp mechanism which will allow immediate release of the bicycle when desired.

5. A floatation apparatus for use with a standard bicycle, according to claim 1, wherein:

said direction control means comprises a rudder attached to the base of said frame means which is controlled by the motion of the handle bars of said bicycle.

6. A floatation apparatus for use with a standard bicycle, according to claim 1, wherein:

said rotatable drums means have support rods between said floatation means; and said rotatable drums means further having bearing means.

7. A floatation apparatus for use with a standard bicycle, according to claim 1, wherein:

said transmission means comprises a plurality of idler pulleys connected by said belt means to said drum means and to said shaft means.

* * * * *